US006213468B1

(12) United States Patent
Van Dalen et al.

(10) Patent No.: US 6,213,468 B1
(45) Date of Patent: Apr. 10, 2001

(54) GAME

(76) Inventors: Rob Van Dalen, Peperveld 13, 5467 NL Veghel Holland (NL); Arend Pieter Van Dalen, Wohnung 15 Dampfschiffstrasze 4, 54290 Trier (DE)

( * ) Notice: Subject to any disclaimer, the term of this patent is extended or adjusted under 35 U.S.C. 154(b) by 0 days.

(21) Appl. No.: 09/270,170

(22) Filed: Mar. 16, 1999

(30) Foreign Application Priority Data

Mar. 17, 1998 (GB) ..... 9805679

(51) Int. Cl.[7] ..... A63F 3/00
(52) U.S. Cl. ..... 273/244; 273/247
(58) Field of Search ..... 273/236, 244, 273/247

(56) References Cited

U.S. PATENT DOCUMENTS

| | | | | |
|---|---|---|---|---|
| 3,907,295 | | 9/1975 | Eissler | 273/244 |
| 3,941,386 | * | 3/1976 | Nelson | 273/244 X |
| 5,224,710 | * | 7/1993 | Feokhari | 273/247 |
| 5,901,956 | * | 5/1999 | Warmack | 273/244 |

FOREIGN PATENT DOCUMENTS

| | | | | |
|---|---|---|---|---|
| 1186708 | * | 5/1985 | (CA) | 273/244 |
| 3607209 | * | 9/1987 | (DE) | 273/244 |
| 0205690 | | 12/1986 | (EP) . | |
| 608364 | | 9/1948 | (GB) . | |
| 2187967 | | 9/1987 | (GB) . | |
| 2201352 | | 9/1988 | (GB) . | |
| 8800853 | | 2/1988 | (WO) . | |

* cited by examiner

*Primary Examiner*—John A. Ricci
(74) *Attorney, Agent, or Firm*—Biebel & French

(57) ABSTRACT

A board game comprising: (i) a board (13) defining a playing area (24) divided into two halves (20, 22) each of which is subdivided into regions (1–12) each bearing an indicia; (ii) a playing piece for movement between the regions; (iii) means for randomly determining to which region the playing piece is moved; (iv) means for randomly determining the outcome of an event associated with the region on which the playing piece is situated; and (v) rules determining how two opposing players may move the playing piece in an attempt to achieve a specified aim. The random determining means preferably comprises a plurality of dice and the rules specify how many dice a player uses in a given situation to determine the outcome of an event or movement of the playing piece. The game may also include means for recording and displaying parameters selected by a player used for biasing the outcome of certain events.

28 Claims, 8 Drawing Sheets

GAME

The present invention relates to a board game which, in each of its different variants, represents one of a variety of games in which teams of human players attempt to gain control of a playing piece such as a ball and score a goal with it.

An object of the invention is to provide a board game which can be played by two players, represents a real life game of the type set out above such as football, basketball, ice hockey, American football, etc. and provides situations commonly encountered in the course of playing the real life game to thereby provide the same type of excitement as is encountered when playing or spectating the real life game. Two major sources of such excitement involve (i) taking possession of the playing piece (which will be referred to simply as a ball at some points below, although it may be an ice hockey puck or some other playing piece) and (ii) encountering situations in which players have unequal chances of gaining success in a particular part of the play.

A further object of the invention is to provide such a board game which does not include individual pieces each of which represents a human player and a playing piece which is physically moved between the players and needs to be physically projected into a goal of the board in order for a goal to be scored. Some such indoor games with pieces representing human players have been produced in the past. Due to the generally static nature of the pieces representing the human players and the extremely small size of the indoor playing area compared to that used by human players, the games tend not to provide a level of excitement anywhere near that encountered when spectating or playing a real life game.

According to the invention there is provided a board game comprising:

(i) a board defining a playing area divided into two halves each of which is subdivided into regions each bearing an indicia;

(ii) a playing piece for movement between the regions;

(iii) means for randomly determining to which region the playing piece is moved;

(iv) means for randomly determining the outcome of an event associated with the region on which the playing piece is situated; and (v) rules determining how two opposing players may move the playing piece in an attempt to achieve a specified aim.

Preferably the playing piece random movement determining means comprises at least part of the event random outcome determining means, and more preferably each random determining means comprises a plurality of like random number generating means.

Conveniently each half defines n regions where n is a whole number multiple m of the maximum number generatable by each of the like random number generating means and the regions of each half of the board are each marked with one indicia which comprises one of the numbers from 1 to n.

When each half comprises 12 regions the maximum number generatable by each random number generating means is preferably 6.

The rules preferably provide that when the playing piece moves to a new region, a play-off for control of the playing piece takes place involving:

(a) each player utilising m random number generating means; and (b) the player obtaining the highest cumulative number moving the playing piece to the region of the opponent's half of the board marked with the number corresponding to the highest cumulative number. Such rules preferably also provide that in the course of a play-off for control of the playing piece, if one player generates with the random number generating means a cumulative number corresponding to the number of the region on which the playing piece is situated the play-off is repeated.

In order to make the playing of the game as varied and interesting as possible preferably the event random outcome determining means is adaptable to be conditionally biased in favour of one player. Such conditional biasing may conveniently be effected by the players using different numbers of the random number generating means when deciding the outcome of one or more specified events.

Preferably the rules provide that the player generating the highest single number by means of any one of the random number generating means used succeeds in the event being decided upon.

In football, basketball and ice hockey versions of the game, preferably each half of the board has a goal associated therewith and the rules specify:

(i) that a player can attempt to score in the goal of the opponent at least when either the player has moved the playing piece to a region of the opponent's half designated for such a purpose or the player has generated two identical numbers with two of the random number generating means; and (ii) situations in which an attempt to score a goal is a specified event subject to said conditional biasing.

In an enhanced version of the game employing conditional biasing, preferably the board is divided into multi-region sectors and the game further comprises biasing integer recording and display means with which each player can record a biasing integer for each sector to determine the number of random number generating means used by a player in the course of playing-off for control of the playing piece when it is situated in a region of that sector, the rules providing that such playing-off is a specified event subject to said conditional biasing. Such recording and display means will facilitate the recording of such biasing integers and allow both players to easily see what biasing integers the other player has chosen. Preferably the biasing integer recording and display means for each player includes selectively displayable integer groups each group containing the same number of integers, which number corresponds to the number of sectors on the board and the sum of the integers of each group being the same.

In order to make the game even more interesting the rules provided that a player may at certain stages of the game change the biasing integers recorded for each sector.

Preferably at least one region of each half is marked to indicate that a player moving the playing piece to that region loses control of the playing piece.

So as to increase the unpredictableness of each game played and to provide a means to make the playing of the board game more like the playing of the real game, preferably the game further comprises cards which provide, in a random manner, instructions concerning the playing of the game and at least one region of each half is marked to indicate that a player moving the playing piece to that region should draw one of the cards. Advantageously some cards include instructions to be followed immediately upon being drawn and others included strategic instructions and may be retained by a player for subsequent use. More preferably the game includes plural different sets of cards and each region marked to indicate that a card should be taken is also marked to indicate from which set a card should be drawn.

When such cards are provided the rules may determine that when the playing piece moves to a region marked to indicate that a card should be drawn, a play-off between the players occurs to determine what subsequent action should be taken.

A version of the game in accordance with the present invention, which utilizes at least some of the features of the game referred to above and which represents a game of America football may also be provided. In such a game the board represents an American football pitch divided into ten strips each further subdivided into ten parts each representing one yard of a real pitch and the game further includes:

(i) a ten yard marker for selectively marking one of the strips of the board representing a ten yard strip of a real pitch;

(ii) a play position marker separate from the playing piece for temporarily marking a point of progress during a player's turn; and (iii) a "downs" indicator for indicating how many "downs" or plays of a player's turn have been used. Preferably the "downs" indicator is adapted to individually and sequentially display the numbers 1 to 4 and the game further comprises random play type determining means for determining whether an offensive player is to use "passing play" or "running play" in a "down" or play and for determining whether a defending player is preparing to stop "passing play" or "running play" in that "down".

So as to reflect the playing of the real game, preferably the rules provide that a player must achieve, in four "downs", progress on the board representing ten yards of a real pitch to maintain control of the playing piece and specify:

(i) the number of random number generating means used by each player, which numbers depend on instructions determined by the play type determining means; and (ii) how the numbers generated by the random number generating means are used to compute the players'progress or result in loss of control of the playing piece to the other player.

Preferably the rules provide that in a player's fourth "down" the random number generating means may be used to determine to which region of the opponent's half of the board the playing piece will move and this results in the opponent gaining control of the playing piece.

Conveniently each random number generating means comprises a die and the game includes a set of random number generating means or dice for each player.

Since play may be determined upon completion of a certain amount of playing time, the game preferably also includes a timer for determining play duration.

Conveniently the game also includes score recording and display means for displaying the score of each player.

While a plurality of dice are preferably used as the random determining means, alternative random number generating means can be employed such as spinners each of which has a polygonal disc mounted perpendicularly to a shaft. Each side of the polygonal disc being marked with some representation of a number. Six-sided dice are commonly available and therefore preferred. Dice, spinners, etc. which randomly generate numbers other than 1 to 6 can be employed. References to dice which follow should be construed as covering such alternative random number generating means.

While only two dice may be used for random movement determination, the game may include more dice for possible use in the course of randomly determining the outcome of an event associated with a region.

BRIEF DESCRIPTION OF THE DRAWINGS

Games in accordance with the invention will be described by way of example only with reference to the accompanying figures in which:

FIG. 1 shows a board for playing a football game in accordance with the invention on;

FIG. 2 shows a board for playing a basketball game in accordance with the invention on;

FIG. 3 shows a board for playing an ice hockey game in accordance with the invention on;

FIG. 4 shows a board for playing an America football game in accordance with the invention on;

DETAILED DESCRIPTION OF THE INVENTION

Figure 1:
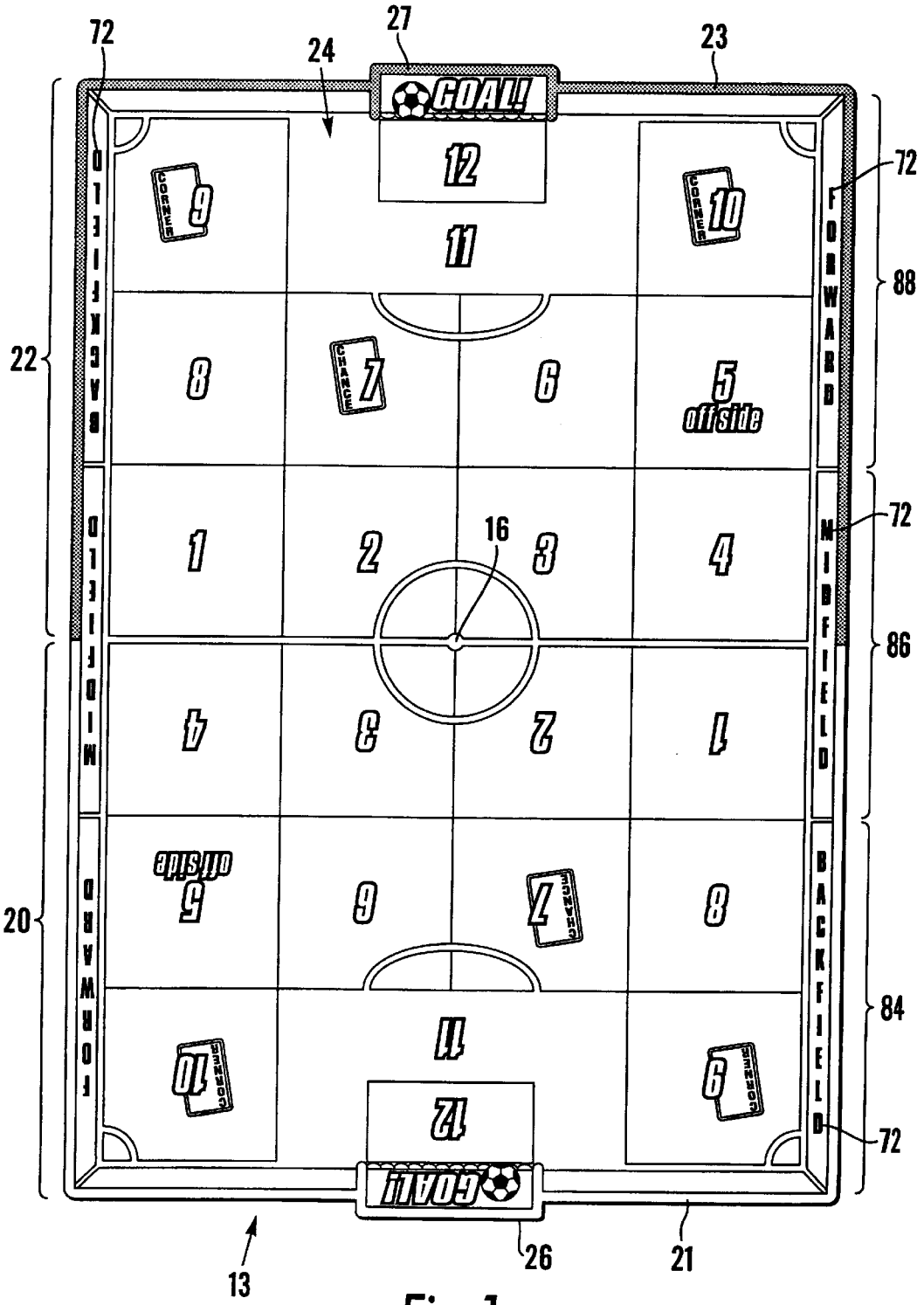

A board 13 on which a football version of the game can be played is shown in FIG. 1. The board defines a playing area 24 comprising a first half 20 and a second half 22 each of which is divided into 12 regions numbered 1 to 12 and has a goal 26, 27. The first and second halves 20, 22 are surrounded by lines 21, 23 of different colours (respectively red and blue in the coloured version of the board). The regions of each half comprise: (i) corner regions 9 and 10; (ii) chance card region 7; (iii) penalty box region 11; (iv) goal mouth box region 12; (v) offside region 5; and (vi) remaining regions 1 to 4, 6 and 8. The board also defines a centre spot 16. The game also comprises a stack of CHANCE cards and a stack of CORNER cards. The text on each CHANCE card is selected from the list which appears below under the title "Football Cards 1". The text for the CORNER cards is likewise shown below under the title "Football Cards 2". Each stack may contain one or more cards corresponding to some or all of the lines in the appropriate list. The first part of each list comprises 20 texts for standard instructional CHANCE/CORNER cards, followed by 10 texts for strategy CHANCE/CORNER cards. Standard cards include instructions which have to be acted upon at the time they are taken whereas strategy cards can be retained for use at a later stage in the game.

The game also includes a playing piece 25 (shown on the left of FIG. 5) for movement between the regions and two dice for each player.

When the basic football version of the game is being played, the board 13 need not include the set up area names 72 which extend along each side of the board 13. The function of these names will be described below with reference to the enhanced football version of the game.

The basic rules governing the playing of the football, basketball and ice hockey versions of the game are given below. These basic rules are described with particular reference to the board shown in FIG. 1 and to the use of two dice by each player. It should be noted however that the rules would also be applicable to a game including a board having other than 12 regions in each half and random determining means other than two dice such as more than two dice or spinners such as those described above. Furthermore, the regions could bear indicia other than numbers, e.g. letters in which case a die or spinner bearing letters could be used for playing piece movement determination.

One player, playing from the second half 22 surrounded by the blue line 23, will attempt to score goals in goal 26 and the other, playing from the first end 20 surrounded by the red line 21, will attempt to score goals in goal 27.

The first player to go rolls two dice and moves the playing piece to the region bearing the number corresponding to the total of the numbers shown by the two dice in the half in which he is attempting to score goals.

Both players then roll two dice and the player with the highest total takes possession of the playing piece and moves it to the region bearing that number in the half in which he is attempting to score goals.

This continues until a player lands the playing piece on one of the regions which is designated as a region from which a shot at goal can be attempted. On the boards depicted in FIGS. 1, 2 and 3 these are regions 11 and 12. If the playing piece is on region 11, the attacker rolls one die and the defender rolls two, if it is on region 12 however the attacker and defender both roll one die. In either case the highest scoring die determines the outcome. Should the attacker roll a die number exceeding that of the defender, then a goal is scored and the playing piece is returned to the centre spot 16. The player who has scored the goal then rolls both dice to determine where the playing piece moves to next and play proceeds as discussed above. If on the other hand, when an attempt is being made to score a goal, the attacker does not roll more than the defender, the defender gains control of the playing piece and rolls both dice to determine which region of the half he is attacking the playing piece will move to.

The game can be made more interesting by the use of the CHANCE and/or CORNER cards, the form of which are discussed above. Further rules relating to the use of CORNER and CHANCE cards and other sophistications which can be incorporated into the rules of the game are set out below under the heading "Basic Football Rules". The Basic Football rules comprise a more complex set of rules for the game to be played on the playing area shown in FIG. 1.

Figure 7:
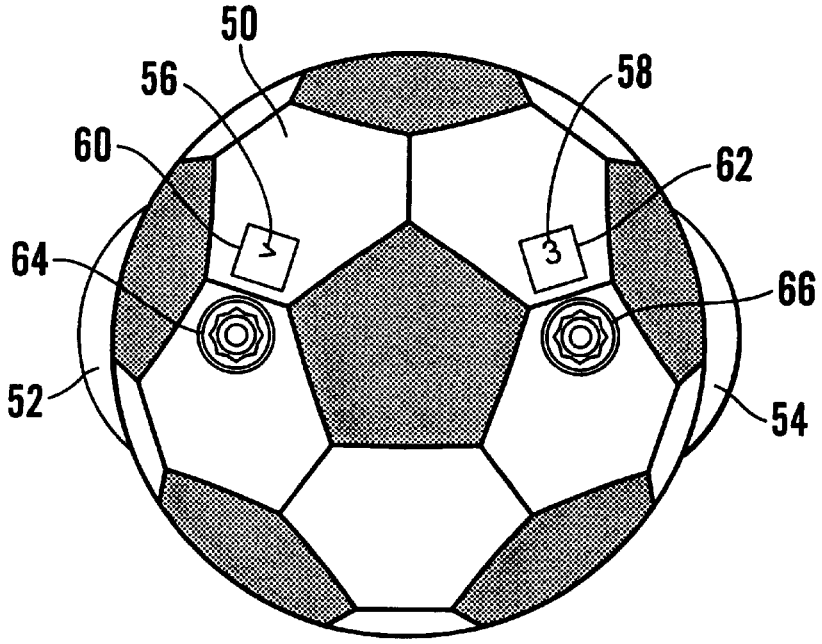
FIG. 7 shows a device for recording the scores of two players.

The game may also include a recording device such as that shown in FIG. 7, on which players' scores can be recorded. The device includes a main body 50 with two windows 60 and 62. A pair of discs 52 and 54 bearing score numbers 56 and 58 are rotatably mounted to the rear of the body 50 by means of pivots 64 and 66. By rotating one of the discs, the different numbers on it can be brought into alignment with the corresponding window. Although the scoring device shown in FIG. 7 is in the form of a football, some alternative form could be employed such an ice hockey puck or a American football.

Figure 8:
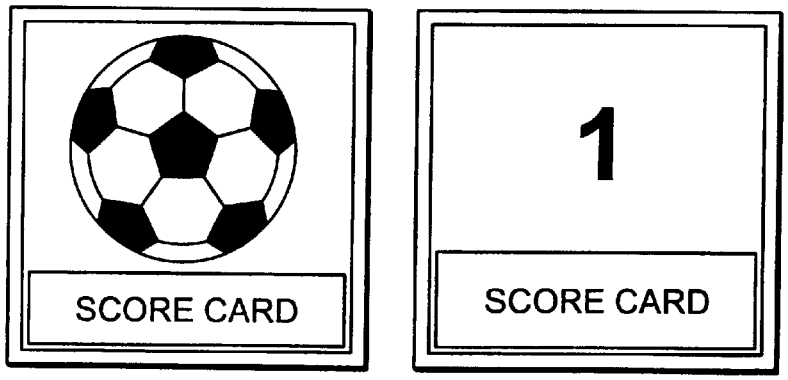
FIG. 8 shows alternative score recording means.

Alternatively a set of score cards may be provided for each player comprising, for example, ten individual cards each bearing a number from 1 to 10 thereon. The front and rear of one score card from such a set is shown in FIG. 8.

A game according to the invention may include a sophistication which will be referred to as "set-up options". Such set-up options allow players to distribute attacking and defending strength in a particular manner. The game board regions will be divided into set-up sectors or areas and each player will elect a certain set-up option before play commences. The set-up option elected by a player conveniently comprises a number associated with each set-up area, the sum of such numbers being subject to a specified maximum or the sequence of set-up numbers being selected from a predetermined list of available sequences. The chance of a player gaining control of the playing piece in a particular set-up area will be biased by the set-up numbers that the two players have allotted to that set-up area. For example, if control of the playing piece is being contested in a region in which the attacker has specified a set-up number 4 and the defender has specified a set-up number 3, then the attacker would roll four dice and the defender would roll three dice. The player who rolls the two dice with the highest combined number will take control of the playing piece and then roll two die to determine the region to which the playing piece moves.

A specific example of a game employing such a set-up option facility will be described with reference to FIG. 1 which shows a board 13 for the enhanced version of the football game. The marking of the board and the playing of the game will be generally as described above with reference to the basic football game. The enhanced football game board additionally includes set-up area names 72. For each player, the two rows of regions closest to his own goal are designated as the "backfield" regions 85, the two centre rows are designated as the "midfield" regions 86 and the two rows nearest to his opponent's goal are designated as the "forward" regions 88.

Figure 4:
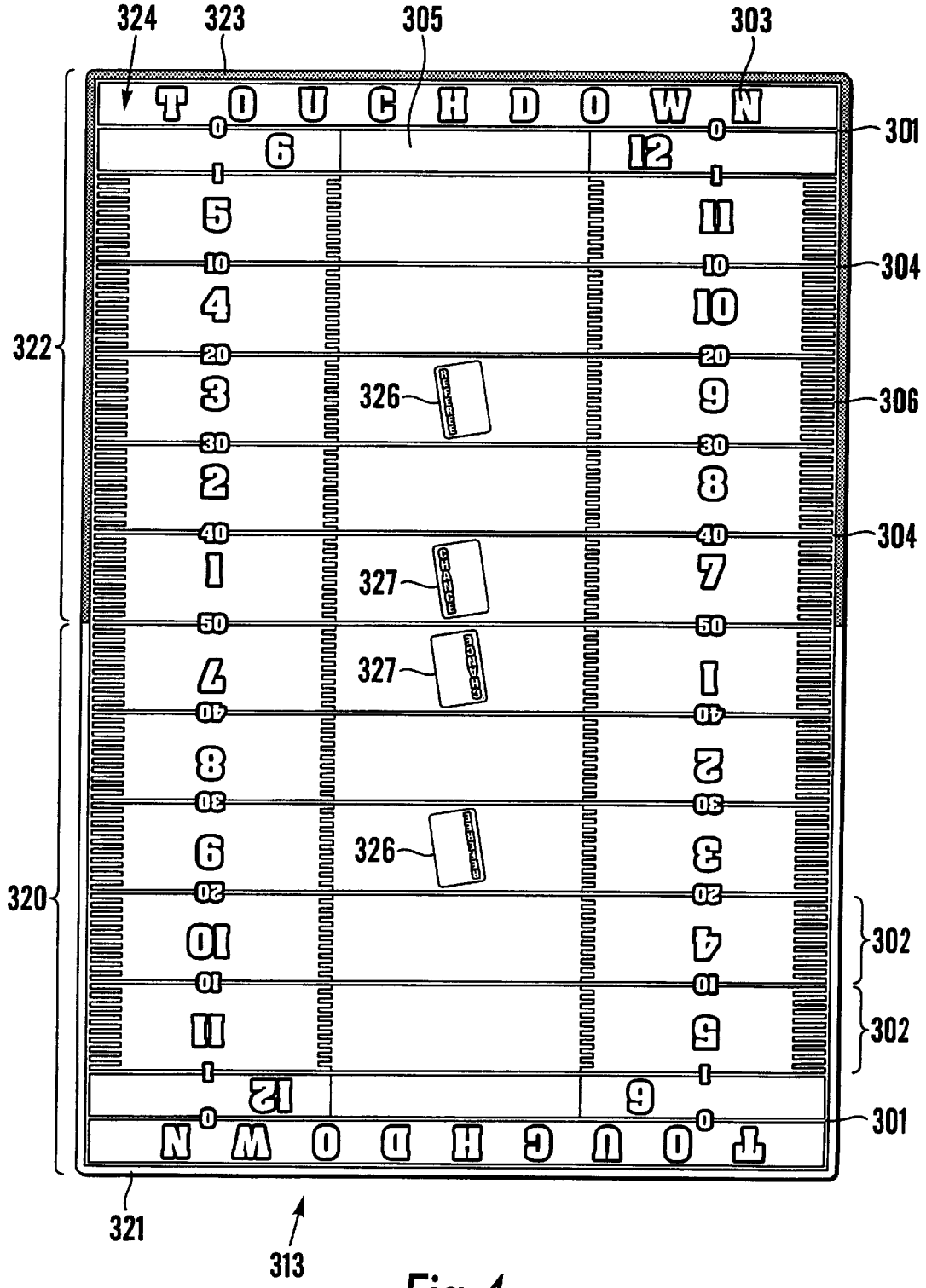
Figure 9:
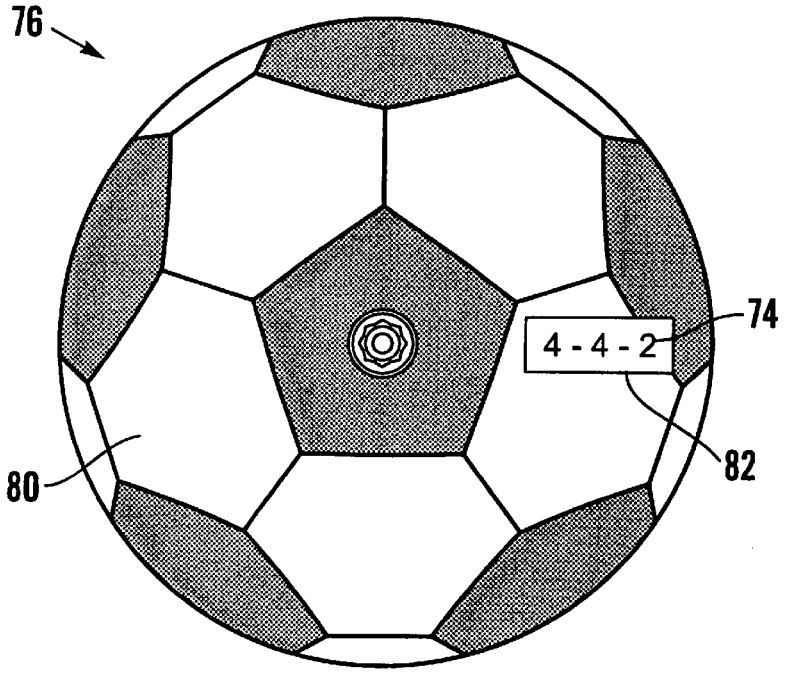
FIG. 9 shows a top plan view of a device for recording game playing parameters.
Figure 10:
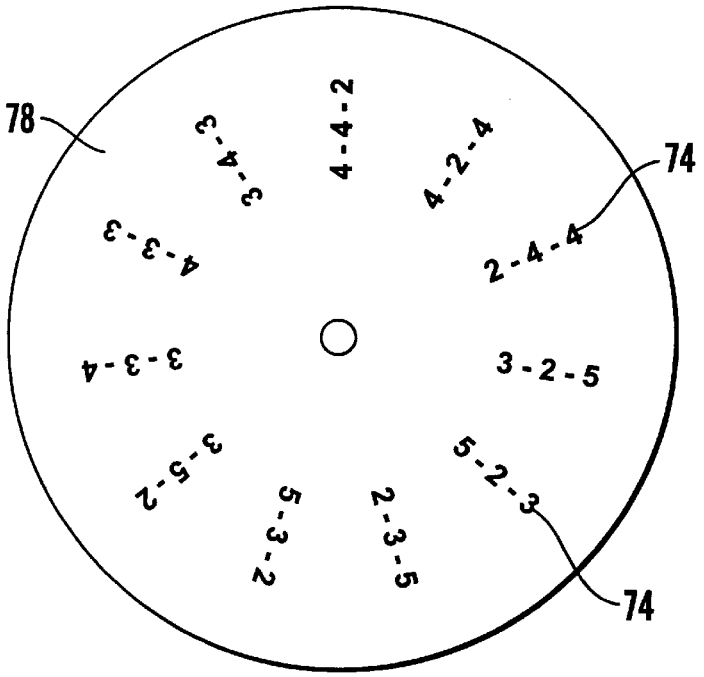
FIG. 10 shows a rotatable disc part of the device shown in FIG. 9.

Before play commences, each player elects a set-up option from those available on a set-up option recorder 76 shown in FIG. 9. The recorder 76 has a rear disc 78 bearing the options 74 available and a front disc 80 having a window 82 behind which the set-up option 74 selected is positioned. Since the maximum number for a region is five in this example, each player will have five dice for possible use during a play-off or contest for possession of the playing piece. The option 74 shown in FIG. 4 is 4-4-2, which means that a first player attacking goal 27 would, when playing for possession of the playing piece, roll four dice in his backfield and midfield regions and two dice in his forward regions. The number of dice rolled by the other player would depend on the second player's particular set-up option for that game. If the second player had selected a 3-2-5 set-up option, then in the first player's forward regions 88 (5 to 10) the attacker (first player) would roll two dice and the defender (second player) would roll three dice. Accordingly, in these regions the attacker would have a lower chance than the defender of having a higher single die score, and consequently a lower chance of maintaining control of the playing piece and moving to region 11 or 12 to take a "shot" at goal 27.

A more detailed set of rules for playing the enhanced football game is set out below under the title "Enhanced Football Rules".

Figure 6:
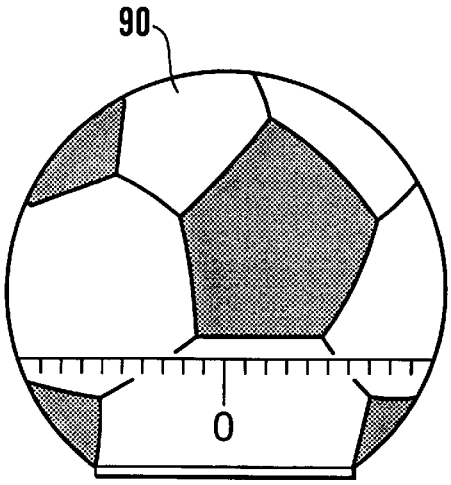
FIG. 6 shows a timer for use in an enhanced football version of the game.

A timer 90 for use in determining the duration of play of the football version of the game is shown in FIG. 6.

Figure 2:
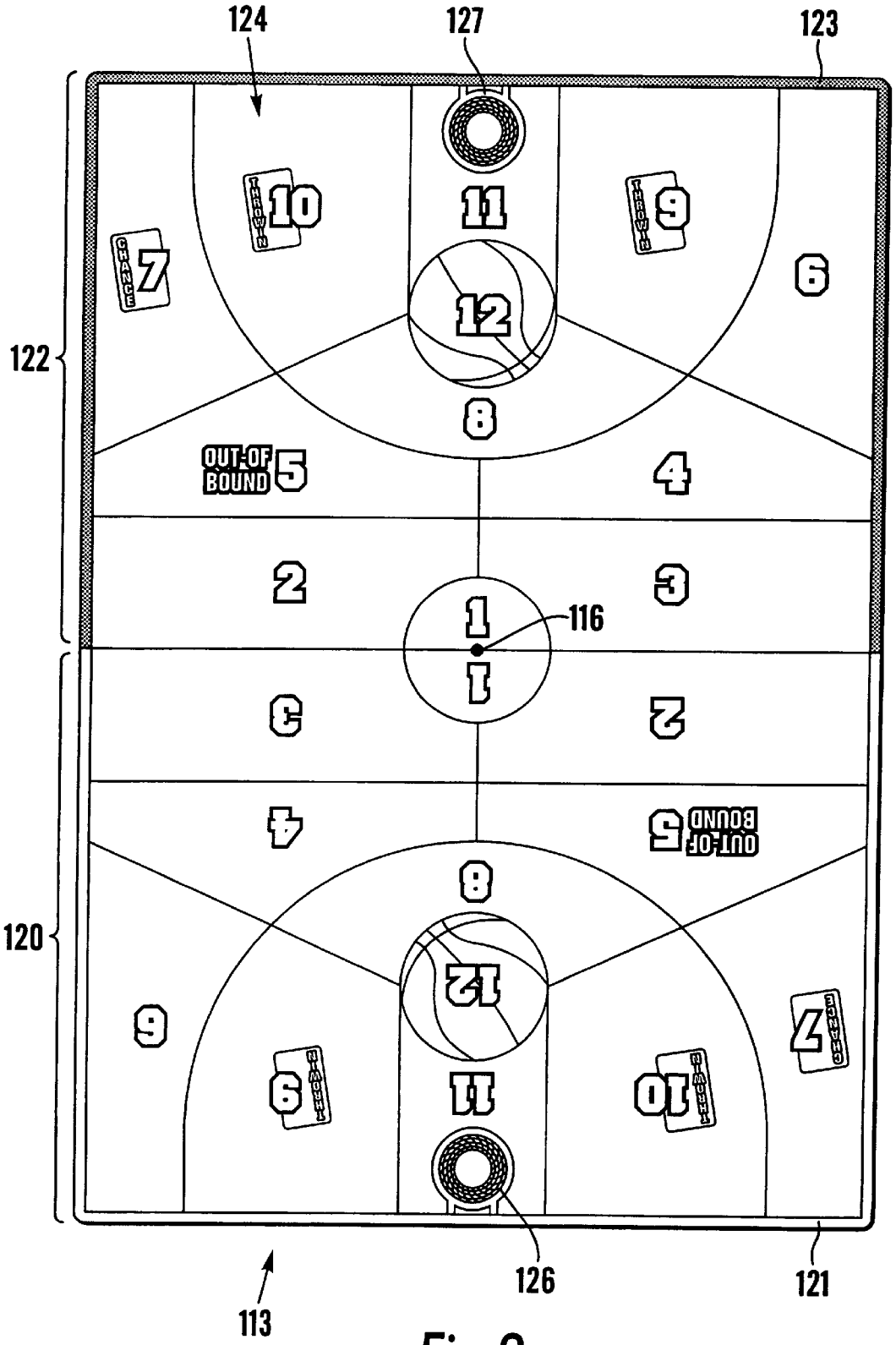
Figure 5:
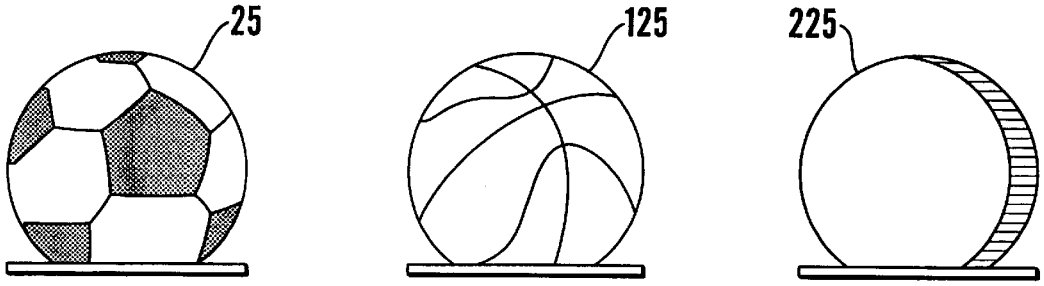
FIG. 5 shows playing pieces or markers for use in the football, basketball and ice hockey versions of the game.

A board 113 on which a basketball version of the game can be played in shown in FIG. 2. Parts of the basketball board which correspond to the equivalent parts of the football board 13 shown in FIG. 1 are designated with the numerals used in FIG. 1 increased by 100. The basketball board 113 has a first half 120 divided into twelve regions marked 1 to 12, a goal or basket 126 and a coloured perimeter line 121 (red on coloured board). The board 113 also has a second half 122 divided into twelve regions marked 1 to 12, a goal or basket 127 and a coloured perimeter line 123 (blue on coloured board). The playing piece 125 for use in the basketball game is shown in the centre of FIG. 5.

The playing piece 125 may be moved and goals or baskets scored substantially in accordance with the rules set out above for the basic football version of the game. A more sophisticated set of rules however which will make the playing of the basketball version of the game more interesting, appears below under the heading "Basketball Rules". When these rules are used, two sets of cards are provided. The first set of cards are referred to as CHANCE cards the text of which appear below under the heading "Basketball Cards 1". The basketball CHANCE cards include twenty basic CHANCE cards the instructions on which are to be followed immediately upon being drawn and ten Strategic CHANCE cards which may be retained by a player for subsequent use during a game. A CHANCE card is drawn by a player upon landing the playing piece on region 7. The second set of cards are referred to as THROW-IN cards, the text of which appear below under the heading "Basketball Cards 2". The basketball THROW-IN cards include twenty basic THROW-IN cards the instructions on which are to be followed immediately upon being drawn and ten strategic THROW-IN cards which may be retained by a player for subsequent use during a game. A THROW-IN card is drawn by a player upon landing the playing piece on region 9 or 10.

Figure 3:
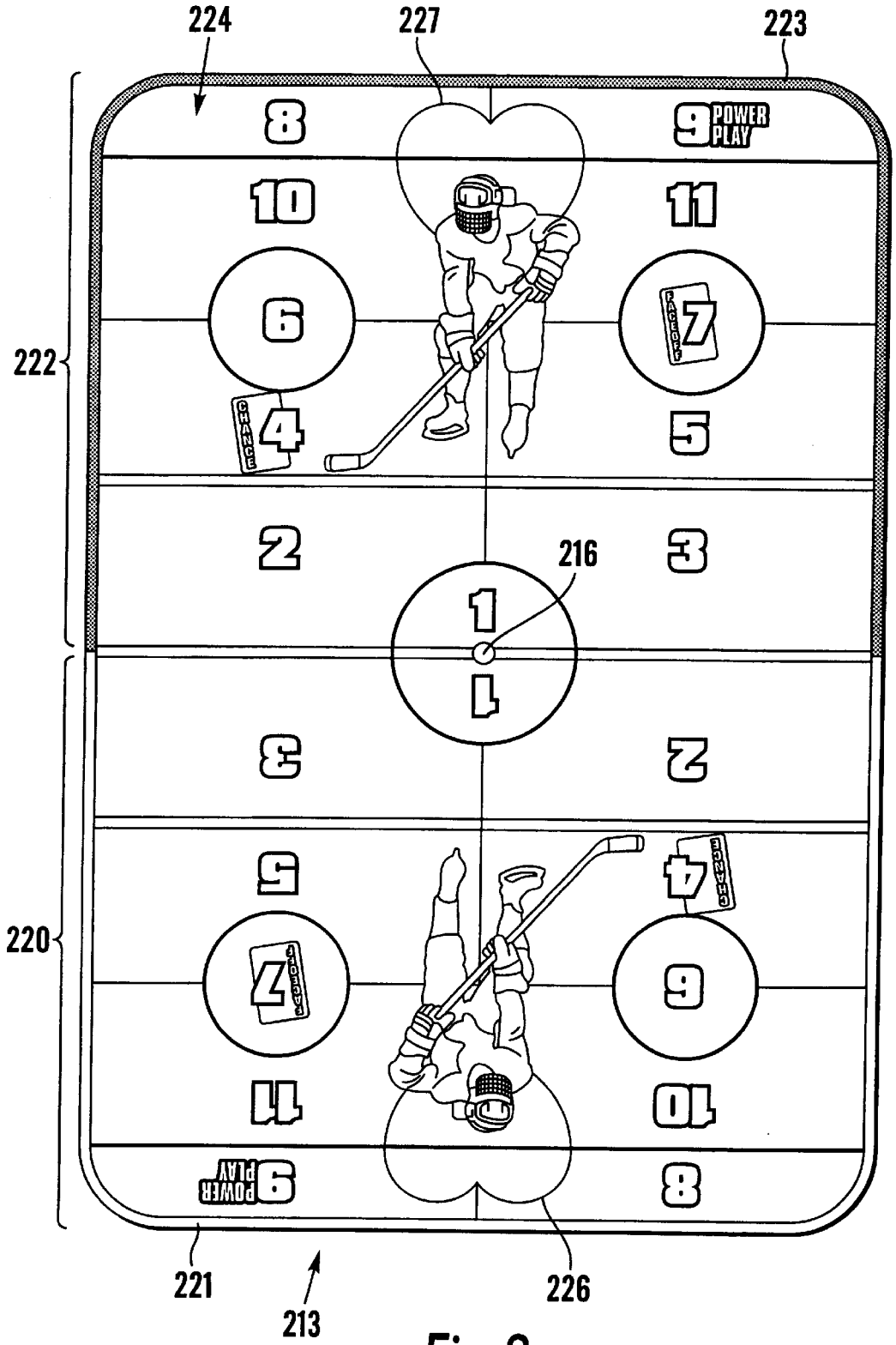

A board 213 on which an ice hockey version of the game can be played in shown in FIG. 3. Parts of the ice hockey board 213 which correspond to equivalent parts of the football board 13 shown in FIG. 1 are designated with the numeral used in FIG. 1 increased by 200. The ice hockey board 213 has a first half 220 divided into twelve regions marked 1 to 12, a goal 226 and a coloured perimeter line 221 (red on coloured board). The board 213 also has a second half 222 divided into regions marked 1 to 12, a goal 227 and a coloured perimeter line 223 (blue on coloured board). The playing piece 225 for use in the ice hockey game is shown on the right of FIG. 5.

The playing piece 225 may be moved and goals scored substantially in accordance with the rules set out above for the basic football version of the game. A more sophisticated set of rules however which will make the playing of the ice hockey version of the game more interesting appear below under the heading "Ice Hockey Rules". When these rules are used two sets of cards are provided. These cards are referred to as CHANCE cards and FACE-OFF cards the text of which appear below under the headings "Ice Hockey Cards 1" and "Ice Hockey Cards 2" respectively. Each of these sets of cards includes twenty basic cards the instructions on which (numbered 1 to 20) are to be followed immediately upon being drawn and ten strategic cards which may be retained by a player for subsequent use during a game. A CHANCE or a FACE-OFF card is drawn by a player upon landing the playing piece respectively on region 4 or 7.

A board 313 on which an America football version of the game can be played is shown in FIG. 4 which includes a playing area 324 divided into a first half 320 surrounded by a coloured line 321 (red on coloured board) and a second half 322 surrounded by a coloured line 323 (blued on coloured board). Each half is divided into strips 302 each of which contains two regions each bearing an indicia in the form of a number from 1 to 12. In each half, the five strips closest to a centre spot 316 of the board are separated from each other by 10 yard lines 304 and sub-divided into ten parts by yard lines 306 such that each of the five strips represents 10 yards of a real American football pitch. The outermost strip 305 of each half, which is not sub-divided by yard lines, is outwardly delimited by a goal line 301. Between each goal line 301 and the adjacent end of the board is a touch down or end zone 303.

Figure 11:
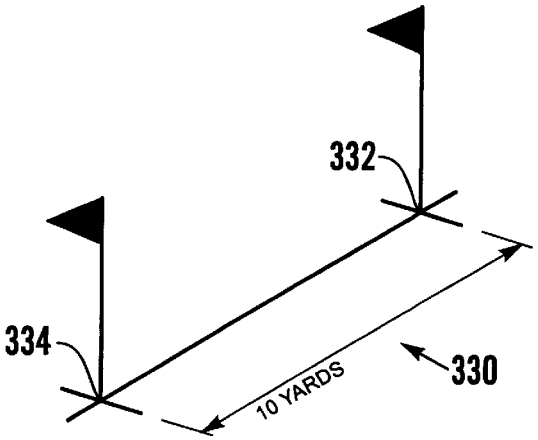
FIG. 11 shows a 10 yard marker for use in the American football version of the game.
Figure 12:
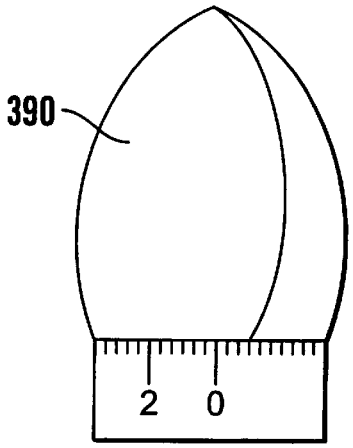
FIG. 12 shows a timer for use in the American football version of the game.
Figure 13:
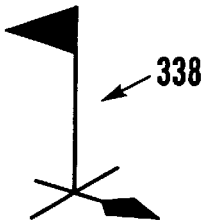
FIG. 13 shows a play position marker for use in the American football version of the game.
Figure 14:
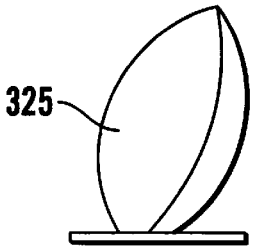
FIG. 14 shows a playing piece or marker for use in the American football version of the game.
Figure 15:
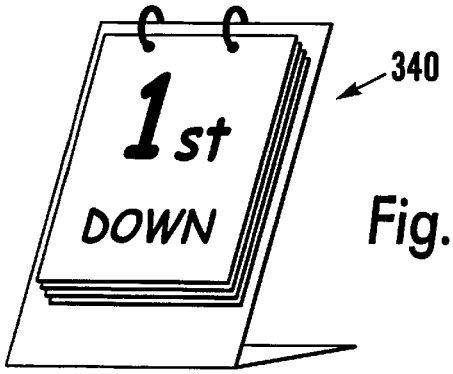
FIG. 15 shows a "down" or play indicator for use in the American football version of the game.

In addition to the playing piece or football marker 325, shown in FIG. 14 a 10 yard marker 330 and a play position marker 338 are also provided which are shown respectively in FIGS. 11 and 13. The 10 yard marker 330 has first and second ends 332 and 334 which are separated by a distance corresponding to that between two 10 yard lines 304 on the board 313. Each player is provided with 3 dice. A "down" marker 340 shown in FIG. 15 is also provided which can selectively and sequentially display the numbers 1 to 4. A timing device 390 shown in FIG. 12 is also provided for controlling play duration.

The strip 302 containing regions 1 and 7 in each half is marked with a CHANCE card 327 and that containing 3 and 9 is marked with a REFEREE card 326. A set of thirty CHANCE cards and a set of thirty REFEREE cards are also provided which bear the texts shown below under the headings "American Football Cards 1" and "American Football Cards 2". Each set contains standard cards (numbered 1 to 20) the instructions on which are to be followed by a player upon being drawn and ten strategic cards which may be retained and used by a player at a later stage in the game.

The game also includes a third set of cards which stipulate whether an offender is to play a "passing" or "running" play and whether a defender is preparing to defend against a "passing" or "running" play.

Rules governing the way the game is played are set out below under the heading "American Football Rules".

With particular reference to rules 9, 10 and 11, the manner in which the playing piece or football marker 325, the 10 yard marker 330 and the play position marker 338 are moved during play will be described below.

When moving the playing piece 325 referred as to a ball below and in the rules, in the American football version of the game it is essential to record the previous position on the board in order to be able to assess whether the offender has moved 10 yards within four "downs" or plays. This is important as a player will lose control of the ball to the other player if a 10 yard gain within the four plays is not achieved.

When the ball 325 has been "kicked" by a first player (see for example rule 4), by the first player rolling two dice, the ball 325 and the play position marker 338 are moved to a position on the board on the 10 yard line 304 at the end of the strip 302 bearing the number corresponding to the cumulative score of the two dice furthest from the first player's end of the board. The 10 yard marker is positioned with its first end 332 at that point and its second end 334 positioned on the adjacent 10 yard line nearer to the first player.

The offender (i.e. the second player will have to move the ball a minimum distance of 10 yards forwards (i.e towards the first player) in four downs or plays to be allowed another chance at covering a further 10 yards in the next four downs or plays. The basic manner in which the ball is moved is set out in rules 7 to 11.

The 10 yard marker will not be moved until the offender has moved the ball 10 yards forwards or the offender has lost control of the ball to the other player.

There now follows an example of how the ball 325, the 10 yard marker 330 and play position marker 338 will be used in the course of an example turn which starts with the first end 332 of the 10 yard marker, the ball 325 and the play position marker 338 on the 10 yard line 304 between regions 4 and 5 and in which the four downs played give the following results:

1st down running play, 4 yard gain

2nd down no gain

3rd down passing play, 11 yards gain or incomplete pass, loss of down

4th down new play option or kick the ball.

When the offence moves 4 yards on the first down the ball 325 and play position marker 338 are moved 4 yards forward to a new position (14 yard line).

On the next down, the second down, no gain is made and the ball 325 and play position marker 338 remain at the 14 yard line.

On the third down, a passing game is played (see rules 6 and 11) which results in forward progress of 11 yards. The ball 325 is moved 11 yards forward to the 25 yard line. At this stage, there is a play-off for control of the ball (see rule 11). The play position marker 338 remains at the 14 yard line and the 10 yard marker 330 remains positioned between the 10 and 20 yard lines.

If the offender wins the throw (play-off), reception of the ball at the 25 yard line is complete and the offender gets a new first down. Accordingly, the play position marker 338 and the first end 332 of the 10 yard marker are moved to join the ball 325 on the 25 yard line.

If the defender wins the throw (play-off), the reception of the ball at the 25 yard line is incomplete and the ball will be moved back to the last play position marked by the play position marker 338 on the 14 yard line.

The offender will now be on the fourth down and has to decide whether to try to gain the final 6 yards needed, to move from the 14 yard line to the 20 yard line, or whether to kick the ball to the other side of the field (see rule 4) in order to obtain a better field position for the defence against the other player who will then become the offender.

In summary, the function of the three markers is as follows:

(i) 10 yard marker marks the original starting position of the first down which is important for deciding if 10 yards have been covered within the 4 downs (plays);

(ii) the play position marker 338 marks the last play position of the ball in the previous down (play);

(iii) ball 325 marks the present location of the ball prior to completion or non-completion of an attempted pass or throw.

The five different variations of the game according to the invention set out above and in the following sets of rules and shown in the accompanying Figures provide a variety of games which will present the players with many of the situations faced in the course of a real game played between teams of players. The excitement caused by the lack of predictability concerning the way in which the game will progress will mean that players of the game will still find the game exciting even after having played it many times.

There now follow five sets of rules (and associated card texts) for playing the games described above and shown in the accompanying Figures.

Basic Football Rules

1. In order to play the game there are 4 dice, 2 for the red team and 2 for the blue team. The red team plays only in the red playing area of the board and the blue team plays only in the blue playing area of the board.
2. The highest throw will start the kick-off, the attacking team will move the ball to the combined total position thrown.
3. Every time the ball arrives on a new position there is at play-off for control of the ball at that position, the highest combined number wins control of the ball. The winner uses the combined total to move to a new location.
4. Position 1 to 10 will allow the player to seek the best position on the field. The objective of the game is to get to position 11 and 12 on the board, in order to be able to get a direct shot at goal. You can only shoot at goal from position 11 and 12 unless differently specified on the Corner card, Chance card, or when doubles are thrown. (see below)
5. When the ball lands on position 5 your team is off side and you will automatically loose the ball to the opposing team.
6. Chance Cards. When the ball lands on position 7, you do not need to play-off for who gets control, but you will automatically receive a Chance card. Follow the instructions. The Chance cards consist of:—1. Standard Chance cards, which instructions you must follow immediately.—2. Strategy Chance cards, these cards you can save and play when you need to give yourself an advantage in the board game. When you save your strategy card for later in the game, then the next throw goes to the opponent.
7. Corner Cards. When the ball lands on position 9 or 10, you play-off for who gets control at that position. In case the defending team wins the ball, then you move to the new location at the other side of the field. In case the attacking side wins control of the ball then you take a Corner card. Follow the instructions. The Corner cards consist of:—1. Standard Corner cards, which instructions you must follow immediately.—2. Strategy Corner cards, these cards you can save and play when you need to give yourself an advantage in the board game. When you save your strategy card for later in the game then the next throw goes to the opponent.
8. Both teams in the game can only use one Strategic Chance card or one Strategic Corner card each per go.
9. Position 11 allows you to shoot at goal, no play off necessary, the attacking teams has one die and the defending team has two dice. The highest die decides if a goal is scored, or if the goalkeeper blocks the ball, in which case the defending team gets the ball.
10. Position 12 allows you to shoot at goal, no play off necessary, the attacking teams has one die and the defending team has one die. The highest die decides if a goal is scored, or if the goalkeeper blocks the ball, in which case the defending team gets the ball.
11. When at any time during the game by either team a double is thrown, the person that throws the double or highest double can take an automatic kick at goal from the position thrown. From all these positions the attacking team throws with one die and the defending team with 2 dice, except on location 12 where it is one on one. When a double is thrown in play off for location 9 & 10, and the attacking team wins, you can either take a Corner card or shoot directly at goal.
12. Whenever the same total number is thrown during the game by the defending team as well as by the attacking team then the advantage will always go to the attacking team.

13. When the team that has control of the ball throws the same number as the location that the ball is at, then the teams have to replay for the control of the ball.
14. When a goal is scored the team that received the goal, will kick off from the middle line to continue the game.
15. The first person to score 10 goals is the automatic winner of the game. When playing a mini league with multiple players you might want to set the target to a lower level of goals, for example 5.

Football Cards 1

Chance Cards

1. Shoot direct at goal.
2. Penalty kick at position 12.
3. Move to position 11 and shoot at goal.
4. Goal!!!
5. Yellow card opponent loses two goes.
6. Move to position 9 and play off for the goal.
7. Move to position 10 and play off for the goal.
8. Move to position 5.
9. Goalkeeper gets ball.
10. Throw in from position 1.
11. Blocked kick opponent gets ball.
12. Free kick for defending team at position 12.
13. Defending team gets ball.
14. Take corner from 9 at goal.
15. Take corner from 10 at goal.
16. Offside, free kick for opponent.
17. Penalty kick at goal from 12.
18. Throw in at 8.
19. Restart game from midfield.
20. Goal!!!

Strategic Chance Cards

1. Yellow card opponent can only throw with one dice.
2. Yellow card opponent looses next go.
3. Block any kick from position 12.
4. Streaker on the pitch, opponent looses concentration move to position 12.
5. Deduct two points of one dice by opponent.
6. When on 12 and behind on points, take 2 penalties at goal.
7. Block any kick from position 11.
8. When opponent throws double 5 you get double 6.
9. This card blocks any strategy card, Your Ball.
10. When opponent at 11, pitch invasion, restart game from midfield.

Football Cards 2

Corner Cards

1. Shoot direct at goal.
2. Penalty kick at position 12.
3. Move to position 11 and shoot at goal.
4. Goal!!!
5. Yellow card opponent loses two goes.
6. Loose control of the ball, goalkeepers ball.
7. Ball kicked behind goal line, goalkeepers ball.
8. Ball headed away to opponent at position 1.
9. Goalkeeper gets ball.
10. Throw in from position 1.
11. Blocked kick opponent gets ball.
12. Free kick for defending team at position 12.
13. Defending team gets ball.
14. Free kick at goal from 9.
15. Take corner from 10 at goal.
16. Offside, free kick for opponent.
17. Pulling down opponent, penalty kick at goal from 12. 18 Defenders to close to corner-kicker, free kick at goal from 11.
19. Restart game from midfield.
20. Goal!!!

Strategic Corner Cards

1. When opponent at 3, articulating at the referee, Penalty at 12.
2. Professional foul, kicking by the opponent, free kick at goal.
3. When at 6, holding on to the opponent's shirt, free kick at goal.
4. When at 11, hand ball by defender, penalty at 12.
5. When at 8, pushing opponent in the back, free kick at goal.
6. Articulating by manager, restart game from midfield.
7. Fireworks in the stand, restart game from midfield.
8. Injured player, throw in for opponent at position 1.
9. Red card, opponent looses next go.
10. Late tackle opponent, free kick at goal from 7.

Enhanced Football Rules

Chance and Corner cards as for Basic Football Rules

Determine Playing Time per Match

Managers Strategy

Before the game begins you have to choose how many players you want per play area. This team set-up decides with how many dice you can throw for control of the ball in each of the three playing areas. These are:

| a. Backfield | b. Mid-field | c. Forward-field |
|---|---|---|

You can choose out of the following set-up options:

| | a-b-c | | a-b-c | | a-b-c | | a-b-c |
|---|---|---|---|---|---|---|---|
| 1. | 4-4-2 | 4. | 4-3-3 | 7. | 5-3-2 | 10. | 5-2-3 |
| 2. | 4-2-4 | 5. | 3-4-3 | 8. | 3-5-2 | 11. | 3-2-5 |
| 3. | 2-4-4 | 6. | 3-3-4 | 9. | 2-3-5 | | |

The Game

1. In order to play the game there are 10 dice, 5 for the red team and 5 for the blue team.
2. Each player always plays in the opposite side of the field. The red team in the red play area and the blue team in the blue play area.
3. To move the ball to a new position each team will throw with 2 dice, the highest throw will start the kick off, the attacking side will move the ball to the combined total position thrown.
4. Every time the ball arrives on a new location there is a play off for who gets control of the ball. The number of dice used depend on the team strategy for the backfield, mid-field, and forward-field. The highest combined total of two dice wins control off the ball. Then you throw again with 2 dice to move to the new position on the field.
5. The players can only change their manager's strategy once a goal has been scored against them. Before the kick-off the player can choose another option.
6. Position 1 to 10 will allow the player to seek the best position on the field. The objective of the game is to get to location 11 and 12 in order to get a direct shot at goal. You can only shoot at goal from position 11 and 12 unless different specified on the corner cards or chance cards.
7. When the ball lands on position 5 your team is off-side and you will automatically loose the ball to the opposing side.
8. Chance cards. When the ball lands on position 7, you do not need to play off for control, but you will automatically receive a Chance card. Follow the instructions. The Chance cards consist of: 1. Standard Chance cards, which instructions you must follow immediately and 2. Strategic Chance cards, these cards you can save and play when you want an advantage in the board game. When you save your strategy card for later in, the game then the next throw goes to the opponent.

9. Corner cards. When the ball lands on position 9 or 10 you play of for who gets control of the ball at that position. In case the defending team wins control then you move to the new position on the other side of the field. In case the attacking team wins you must take a Corner card and follow its instructions. The Corner cards consist of: 1. Standard Corner cards, which instructions you must follow immediately and 2. Strategic Corner cards, these cards you can save and play when you need to give yourself an advantage in the board game. When you save your strategy card for later in the game then the next throw goes to the opponent.
10. Both teams in the game can only use one Strategic Chance card or one Strategic Corner card per go.
11. Position 11 allows you to shoot at goal, no play off necessary, the attacking team has one die and the goalkeeper defend with 2 dice. The highest die decide if a goal is scored, or if the goalkeeper blocks the ball, in which case the defending team gets the ball.
12. Position 12 allows you to shoot at goal, no play off necessary, the attacking team attacks with one die and the goalkeeper defends with 1 die. The highest die decide if a goal is scored, or if the goalkeeper blocks the ball, in which case the defending team gets the ball.
13. When at any time during the game by either team a double is thrown, the person that throws the double or highest double can take a automatic kick at goal from the position thrown. The attacking team can use the number of dice equal to the number of players in that section of the field. The defending team always defends with one dice less.
14. Whenever the same number is thrown during the game by the defending team and by the attacking team then the advantage will always go to the attacking team.
15. When a triple number is thrown during the game the player gets a yellow card. When a triple number is thrown for the second time in the same half of play then a red card is shown. The team that receives the red card will have to throw with one die less then his team set-up every time there is a play off for the ball. At the end of each half of play the yellow & red cards are removed.
16. When at the end off full time the score is a draw, we proceed to a penalty shoot out. 5 one on one dice shots will be taken at each end. If no winner is decided at the end of this, you will continue under sudden death, one shot at a time while the first team not to score looses the game.

Basketball Rules

The Game

1. In order to play the game there are 4 dice, 2 for the red team and 2 for the blue team. The red team plays only in the red playing area of the board and the blue team plays only in the blue playing area of the board.
2. The highest throw will start the game, the attacking side will move the ball to the combined total position thrown.
3. Every time the ball arrives on a new location there is a play-off for who gets control of the ball. The highest combined total of two dice wins control off the ball. The winner uses the combined total to move to a new location.
4. Position 1 to 10 will allow the player to seek the best position on the field. The objective of the game is to get to location 11 and 12 in order to get a direct shot at the basket. You can only shoot at the basket from position 11 and 12 unless different specified on the Throw-in cards, Chance cards, or when doubles are thrown. (see below)
5. When the ball lands on position 5 your team has lost control of the ball and has gone out-of-bound and you will automatically loose the ball to the opposing side.
6. Chance cards. When the ball lands on position 7, you do not need to play off for control, but you will automatically receive a Chance card. Follow the instructions. The Chance cards consist of: 1. Standard Chance cards, which instructions you must follow immediately and 2. Strategic Chance cards, these cards you can save and play when you want an advantage in the board game. When you save your strategy card for later in the game then the next throw goes to the opponent.
7. Throw-in cards. When the ball lands on position 9 or 10 you play off for who gets control of the ball at that position. In case the defending team wins control then you move to the new position on the other side of the field. In case the attacking team wins you must take a Throw-in card and follow its instructions. The Throw-in cards consist of: 1. Standard Throw-in cards, which instructions you must follow immediately and 2. Strategic Throw-in cards, these cards you can save and play when you need to give yourself an advantage in the board game. When you save your strategy card for later in the game then the next throw goes to the opponent.
8. Both teams in the game can only use one Strategic Chance card or one Strategic Throw-in card each per go.
9. Position 11 allows you to shoot at the basket, no play-off necessary, the attacking team has one die and the defending team has 2 dice. The highest die decides if a goal is scored, or if the defending team gets the ball.
10. Position 12 allows you to shoot at the basket, no play off necessary, the attacking team attacks with one die and the defending team also has 1 die. The highest die decides if a goal is scored, or if the defending team gets the ball.
11. When at any time during the game by either team a double is thrown, the person that throws the double or highest double can take an automatic throw at the basket from the position thrown.

Location 2, 4, and 6 attacking team throws with 1 dice defending team with 2 dice. Highest die decides the winner. If attacking team scores then 3 points are allocated.

Location 8 and 10 attacking team throws with 1 dice defending team with 2 dice. Highest die decides the winner. If attacking team scores then 2 points are allocated.

Location 12 attacking team and defending team both throw with one die.

If attacking team scores 2 then points are allocated.
12. Whenever the same number is thrown during the game by the defending team and by the attacking team then the advantage will always go to the attacking team.
13. When the team that has control of the ball throws the same number as the location that the ball is at, then the teams have to replay for the control of the ball.
14. When a team has scored the team that was scored against will restart the game from the middle line to continue the game.
15. When at the end off full time the score is a draw, we proceed to a penalty shoot out. 5 one on one dice shots will be taken at each end. If no winner is decided at the end of this you will continue under sudden death, one shot at a time while the first team not to score looses the game.

Basketball Cards 1

Chance Cards

1. Jump ball play off for possession.
2. Jump ball tipped and played to opponent.
3. Free throw at basket from position 12.
4. Official stops play, restart from position 1.
5. Ball out of bounds throw in other team from 10.
6. Live ball lodges on the basket support, Jump ball at 8.
7. Ball accidentally enters basket from below, Jump ball at 8.
8. Jump ball untapped before hitting the floor retake at 8.
9. Team mates occupy adjacent positions during jump ball, opponent gets ball at 4.
10. Run with the ball violation, opponent gets the ball at 2.
11. Kicking the ball, opponent gets the ball at 4.
12. Striking the ball, opponent gets the ball at 6.
13. Blocking the ball with the knee, opponent gets ball at 9.
14. Shot at Basket. Rebound and Score!!
15. Slam Dunk. Score!!
16. Tap the ball to player at location 12.
17. Airborne shooter Dunks the ball.
18. Two free throws at basket from 12.
19. One free throw at basket from 12.
20. Throw from the field, 2 points.

Strategic Chance Cards

1. Accidental contact card, overrules any personal foul penalty.
2. Accidental contact card, overrules any personal foul penalty.
3. Tripping an opponent, free throw at basket.
4. Blocking offensive player at 12. Two free throws at basket.
5. 'Lay up shot', SCORE!
6. When at 12 Guarding from the rear, free throw.
7. When at 11 hand-checking by opponent, free throw.
8. When opponent at 9 illegal use of the hands, your ball.
9. When opponent at 10 illegal screening, your ball.
10. Shoot at the basket when at 4.

Basketball Cards 2

Throw-in Cards

1. Player exceeding 5 seconds out off bounds time, opponent gets ball.
2. Rebound and score!!
3. Moving prior to throw in, ball goes to opponent.
4. Throw-in player steps in court while releasing ball, opponent gets ball.
5. Throw-in player throws ball over back board, opponents gets ball.
6. Forfeit the game, team refusing to play after referees instruction.
7. Personal foul, free throw from 12.
8. Fumble of the ball, opponents gets ball.
9. Holding, opponents ball.
10. Pass ball to team mate at 12.
11. Pass ball to team mate at 11.
12. Legal guarding position infringement, ball goes to defending team.
13. Behind the back dribble and shoot at goal when at 5.
14. Pivot and shoot at goal when at 6.
15. Player dribbles second time, opponent gets ball.
16. Charging, opponents ball.
17. Exceeding 10 seconds rule to move ball to front court. Opponents ball.
18. Player out of bounds. Opponents ball.
19. Ball out of bounds. Opponents ball.
20. Incorrect throw in. Opponents ball.

Strategic Throw-in Cards

1. When penalised, play double foul card, and maintain control of ball.
2. Technical foul, using offensive language, two free throws.
3. Technical foul, baiting an opponent, two free throws.
4. Technical foul, disrespectful addressing of official, two free throws.
5. Technical foul, obstruction of vision with hands, two free throws.
6. Closely guarded player rules blocks three second rule.
7. When at 12 interference with ball near basket. Your ball.
8. When at 11 unsportsmanlike behaviour, your ball.
9. When at 12, tapping ball from opponents hand, take control of ball.
10. When at 11, "three second rule", hand ball to opponent.

Ice Hockey Rules

The Game

1. In order to play the game there are 4 dice, 2 for the red team and 2 for the blue team. The red team plays only in the red playing area of the board and the blue team only plays in the blue play area of the board.
2. The highest throw will start the game, the attacking side will move the puck to the combined total position thrown.
3. Every time the puck arrives on a new location there is a play off for who gets control of the puck. The highest combined total of two dice wins control off the puck. The winner uses the combined total to move to a new location.
4. Position 1 to 10 will allow the player to seek the best position on the field. The objective of the game is to get to location 11 and 12 in order to get a direct shot at the goal. You can only shoot at goal from position 11 and 12 unless different specified on the Face-off cards, Chance cards, or when doubles are thrown. (see below)
5. Chance cards. When the ball lands on position 4, you do not need to play off for control, but you will automatically receive a chance card. Follow the instructions. The chance cards consist of: 1. Standard Chance cards, which instructions you must follow immediately and 2. Strategic Chance cards, these cards you can save and play when you want an advantage in the board game. When you save your strategy card for later in the game then the next throw goes to the opponent.
6. Face-off cards. When the puck lands on position 7 you play of for who gets control of the puck at that position. The team that takes control will take a Face-off card. The face off cards consist of 1. Standard Face-off cards, which instructions you must follow immediately and 2. Strategic Face-off cards, these cards you can save and play when you want an advantage in the board game. When you save your strategy card for later in the game then the next throw goes to the opponent.
7. When the puck lands on position 9 your team has lost control of the puck and has created a power play situation. You will automatically loose the puck to the opposing side and will have to throw with one dice less for the next three throws.
8. Both teams in the game can only use one Strategic Chance card or one Strategic Face off card each per go.
9. Position 11 allows you to shoot at the goal, when the attacking team wins control off the ball, the attacking team has one die and the defending team has 2 dice. The highest die decide if a goal is scored, or if the defending team gets the ball.
10. Position 12 allows you to shoot at the goal, no play-off necessary, the attacking team attacks with one die and the defending team also has 1 die. The highest die decide if a goal is scored, or if the defending team gets the ball.

11. When at any time during the game by either team a double is thrown, the person that throws the double or highest double can take an automatic shot at the goal from the position thrown.
12. Whenever the same number is thrown during the game by the defending team and by the attacking team then the advantage will always go to the attacking team.
13. When the team that has control of the ball throws the same number as the location that the ball is at, then the teams have to replay for the control of the ball.
14. When a team has scored, then the team that was scored against will restart the game from the middle line to continue the game.
15. When at the end off full time the score is a draw, we proceed to a penalty shoot out. 5 one on one dice shots will be taken at each end. If no winner is decided at the end of this you will continue under sudden death, one shot at a time while the first team not to score looses the game.

Ice Hockey Cards 1

Chance Cards

1. Play-off for possession.
2. Hockey puck played to opponent.
3. Shot at goal from position 12.
4. Official stops play, restart in central play off area 1.
5. Rebound of boards, puck for other team from 10.
6. Face off penalty from 6.
7. Broken stick loss of puck to opposing team.
8. Butt-ending puck for other team at 11.
9. Cross-checking, puck for other team at 8.
10. Elbowing, face off from 6.
11. Checking from behind, opponent gets the puck at 5.
12. Board checking, puck to opponent at 6.
13. Charging at opponent, opponent gets puck at 9.
14. Clipping opponent, penalty from 6 and Score!!
15. Clipping opponent, penalty from 6.
16. Delaying the game, puck goes to opponent.
17. Batting the puck outside playing area. Shot at goal from 10.
18. Face-off at 1.
19. Face-off at 6.
20. Handling puck with hands, go to 7.

Strategic Chance Cards

1. This card, overrules any personal foul penalty.
2. This card, overrules any personal foul penalty.
3. Tripping an opponent, free shot at goal.
4. Illegal blocking of opponent. Shot at goal from 6.
5. Icing the puck, SCORE!
6. When at 12 face off at 6.
7. When at 11, falling on the puck, face off at 6.
8. Off the wall, puck possession at 10.
9. Off the wall, puck possession at 9.
10. Check an opponent. Face off at 6.

Ice Hockey Cards 2.

Face-off Cards

1. Falling on the puck, opponent gets puck.
2. Fisticuffs, puck goes to opponent.
3. Retaliation to earlier incident, puck goes to opponent.
4. Head Butting opponent, free shot at goal.
5. High stick, opponent gets puck at 6.
6. Holding an opponent, puck goes to opponent.
7. Holding opponents stick, puck goes to opponent.
8. Hooking by opponent, free shot at goal from 12.
9. Icing the puck by opponents, face off at 6.
10. Kicking a player, one die penalty for 3 throws against opponents.
11. Interference, free shot at goal from 12.
12. Kneeing, face-off at location 6.
13. Off-side, puck to opponents.
14. Preceding puck into attacking zone, face off at 1.
15. Roughing the opponent, free shot from 5.
16. Charging by opponents, you get puck at 12.
17. Slashing by opponent. You puck at 11.
18. Spearing by opponent. Shot at goal from 6.
19. Throwing stick in defending zone. Shot at goal from 6.
20. Tripping by opponent. Shot at goal from 12.

Strategic Face-off Cards

1. Hooking, possession of puck at 12.
2. Broken stick, opponent loss of play.
3. Refusing to start play, one dice throw for 2 goes by opponent.
4. Throwing the stick, penalty shot from 6.
5. Puck out of bounds restart at 1.
6. Puck out of bounds restart at 7.
7. Icing the puck, your puck, restart at 6.
8. Lost puck, face off at present location.
9. This card blocks any free shot at goal.
10. This card blocks any penalty shot at goal.

American Football Rules

1. The object of the game for each team is to cross the field and get in your opponent's end zone (the area behind the goal line) and score a touch down.
2. In order to play the game there are 6 dice, 3 for the red team and 3 for the blue team.
3. To commence the game both teams will throw with two dice. The team with the highest throw will receive the kick-off.
4. The kick-off team throws with 2 dice and the ball will land on the other side of the field at the combined total thrown. The ball will be marked at the beginning of that 10-yard box.
5. At this location the offence of the other team will get control of the ball and start playing up field. The team has to cover a minimum of 10 yards on 4 plays (downs) or the ball will go to the other team. The offence can kick the ball on 4th down (play) to the other side of the field. When the offence decide not to kick but to play the ball on 4th down, to make the required 10 yards in 4 plays, but are not successful, then the other team will take possession at the last play position.
6. At the beginning of each play the offence draws a Play-drive card. This will advise you which way your quarterback will choose to play 1. A Passing game or 2. A Running game with the ball.
7. At the beginning of each play the defence draws a Play-drive card. This will advise you whether your defence is preparing to stop 1. A Passing play or 2. A Running play with the ball.
8. When the defence draws a card that has the same play option card as the offence then the defence will have one extra die for that play. When the defence has a different play option card, then the offence will have one extra die for that play.
9. On a Running play, the offence throws with 2 or 3 dice (see 8) and the defence will throw with 2 or 3 dice (see 8) Only one die, the single highest die, will count. 1.—When the offence wins then the number thrown is the yards the team moves forward. In case a double is thrown by the offence then both dice combined give the total yards gained. 2.—When the defence wins then there will be a loss of down (play) for the offence.
10. When both teams throw the same numbers there will be no gain by either team and a loss of down (play) will occur for the offence.

11. On a Pass play the offence always throws with 2 dice. Both dice combined give the yards gained. The number thrown is the yards the team moves forward. In case of a double, an extra throw can be taken and added to the previous total. With a Pass Play every time the ball arrives on a new position there is a play-off for completion of the pass at that position. The offence plays with 2 dice and the defence with 3 dice. The highest combined total number off only 2 dice for each team decides whether it is a completed pass. 1.—When the offence wins the play-off the pass is completed and the ball is marked at the point of reception. 2.—When the defence wins the play-off the pass is incomplete and there will be a loss of down (play) for the offence.
12. Chance Cards. When the ball lands on a Chance card location, you will automatically receive a Chance card. Follow the instructions. The Chance cards consist of:—1. Standard Chance cards, which instructions you must follow immediately.—2. Strategy Chance cards, these cards you can save and play when you need to give yourself an advantage in the board game.
13. Referee Cards. When the ball lands on a Referee card position, you play-off for who gets the Referee card. Follow the instructions. The Referee cards consist of:—1. Standard Referee cards, which instructions you must follow immediately.—2. Strategy Referee cards, these cards you can save and play when you need to give yourself an advantage in the board game.
14. When at any time during the game a double 6 is thrown you will have a special play option. You will throw 2 dice and the ball will land at the combined total location thrown. The ball will be marked at the beginning of that 10-yard box. This will be an automatic first down, and you will have another 4 plays to gain 10 yards.
15. Both teams in the game can only use one Strategic Chance card or one Strategic Referee card each per go.
16. Position 25 allows you the option to take a field goal, the attacking team has one die and the defending team has two dice. The highest die decides if a goal is scored, or if the kicker missed the goal. In case of a miss there will be a loss of down (play) for the offence.
17. When at any time during the game by either team a triple is thrown, the team that throws the triple or highest triple will have an immediate fumble (dropped ball ) at that location. The possession of the ball will go to the other team.
18. Scoring. A touch down is scored when the offence takes the ball into the end zone (the area behind the goal line). The team that scored the touch down will receive 6 points.
19. Scoring. Following the touchdown your team can go for a try kick for a one-point conversion, both team throw with 2 dice. When the offence wins then they will receive one point. When the defence block the kick the defence will take control of the ball at the 20 yards line.
20. Scoring. When a field goal is attempted the offence will throw with one die and the defence will defend with 3 dice. The single highest die on both sides will decide if a goal is scored. When the offence wins they will get 3 points. When the defence wins they will get possession at the kicking position on the board or at the 20 yards line whichever is the highest.
21. When a touch down or penalty goal is scored the team that scored the goal, will kick off from the 35 yards line to continue the game.
22. The game is nearly finished when the pre-set game clock gives the 2 minutes warning and when the game clock subsequently runs out the final score at that time will decide the winner.

Accessories for the American Football Game
3 dice for each team
Football marker
10 yard chain marker
Play position marker
Chance cards
Strategic Chance cards
Referee cards
Strategic Referee cards
Score cards
Offence/Defence pass cards
Offence/Defence run cards
Time clock, with two minutes warning before end of the game.
Downs marker: 1st, 2nd, 3rd, 4th down.
American Football Cards 1
Chance Cards
1. First down
2. Fumble at point of reception
3. Delay of game, loss of down
4. Loss of down
5. Holding, 10 yard penalty in your favour
6. Interference, 1st down at site of infraction
7. Illegal use of hands, 10 yard penalty in your favour
8. Pass is incomplete
9. Replay of down
10. When in possession. Touch down!
11. Immediate field goal attempt
12. Automatic first down
13. Automatic first down
14. Free play, move forward combined total of your dice
15. Free play, move forward total highest single die
16. Drop kick, receiver recovers kick 20 yards gain
17. Out of bounds, loss of down
18. Loose ball, highest dice of both teams recovers
19. Quarterback sack, 10 yards loss on play
20. Quarterback sack, 5 yards loss on play
21. Running back tackled behind scrimmage, 5 yards loss of play Strategic Chance Cards
1. Fumble recovery
2. Fumble recovery
3. Penalty refused
4. Pass is incomplete
5. Safety, when opponents defence between 1 and 5 yard line
6. Too many men on the filed, 5 yard penalty
7. Delay of game, loss of down
8. When incomplete pass repeat of down
9. Fair catch
10. First down on one yard line American Football Cards 2
Referee Cards
1. Completed pass, touch down
2. First down
3. Crowd noise, 5 yard penalty
4. Ball has been illegally touched, loss of down
5. Ball has been illegally kicked, loss of down
4. Ball has been illegally batted, loss of down
7. False start, 5 yard penalty
8. Personal foul, roughing the passer, 15 yard penalty
9. Illegal use of hands, 10 yard penalty
10. Pass was juggled in bounds and caught out of bounds
11. Illegal forward pass, loss of down
12. Invalid fair catch, 5 yard penalty
13. Illegal motion at the snap, 5 yard penalty
14. Loss of down
15. Personal foul, Chop block, 15 yard penalty 16. Personal foul, Clipping, 15 yard penalty
17 Tripping, 10 yard penalty
18. Too many men on the field, 5 yard penalty
19. Illegal substitution, 5 yard penalty
20. Not deliberate face mask, 5 yard penalty Strategic Referee Cards 1. Delay of game, loss of down
2. Illegal formation, 5 yard penalty
3. Personal foul, Roughing the kicker, 15 yard penalty
4. Personal foul, Major face mask, 15 yard penalty and first down
5. Holding, 10 yard penalty
6. Intentional grounding, 10 yard penalty and loss of down
7. Interference, 1st down at site of infraction
8. Ineligible receiver downfield, 5 yard penalty
9. Unsportsmanlike conduct, 15 yard penalty
10. Illegal shift, 5 yard penalty

What is claimed is:

1. A board game comprising:

(i) a board defining a playing area divided into two halves each of which is subdivided into regions each bearing an indicia;

(ii) a playing piece for movement between the regions;

(iii) means for randomly determining to which region the playing piece is moved;

(iv) means for randomly determining the outcome of an event associated with the region on which the playing piece is situated;

(v) rules determining how two opposing players may move the playing piece in an attempt to achieve a specified aim;

(vi) wherein each random determining means comprises a plurality of like random number generating means, and each half defines n regions where n is a whole number multiple m of the maximum number generatable by each of the like random number generating means; and (vii) wherein the rules provide that when the playing piece moves to a new region, a play-off for control of the playing piece takes place involving:

(a) each player utilising m random number generating means; and (b) the player obtaining the highest cumulative number moving the playing piece to the region of the opponent's half of the board marked with the number corresponding to the highest cumulative number.

2. A game according to claim 1 wherein the playing piece random movement determining means comprises at least part of the event random outcome determining means.

3. A game according to claim 1 wherein the regions of each half of the board are each marked with one indicia which comprises one of the numbers from 1 to n.

4. A game according to claim 1 wherein each half comprises 12 regions and the maximum number generatable by each random number generating means is 6.

5. A game according to claim 1 wherein the rules provide that in the course of a play-off for control of the playing piece, if one player generates with the random number generating means a cumulative number corresponding to the number of the region on which the playing piece is situated the play-off is repeated.

6. A game according to claim 1 wherein the board represents a football or ice hockey pitch or a basketball court.

7. A game according to claim 1 wherein each random number generating means comprises a die.

8. A game according to claim 1 including a set of random number generating means for each player.

9. A game according to claim 1 including a timer for determining play duration.

10. A game according to claim 1 including score recording and display means for displaying the score of each player.

11. A board game comprising:

(i) a board defining a playing area divided into two halves each of which is subdivided into regions each bearing an indicia;

(ii) a playing piece for movement between the regions;

(iii) means for randomly determining to which region the playing piece is moved;

(iv) means for randomly determining the outcome of an event associated with the region on which the playing piece is situated;

(v) rules determining how two opposing players may move the playing piece in an attempt to achieve a specified aim;

(vi) wherein each random determining means comprises a plurality of like random number generating means, and the event random outcome determining means is adaptable to be conditionally biased in favour of one player; and (vii) wherein the rules provide that the conditional biasing is effected by the players using different numbers of the random number generating means when deciding the outcome of one or more specified events.

12. A game according to claim 11 wherein the rules provide that the player generating the highest single number by means of any one of the random number generating means used succeeds in the event being decided upon.

13. A game according to claim 11 wherein each half of the board has a goal associated therewith and the rules specify:

(i) that a player can attempt to score in the goal of the opponent at least when either the player has moved the playing piece to a region of the opponent's half designated for such a purpose or the player has generated two identical numbers with two of the random number generating means; and (ii) situations in which an attempt to score a goal is a specified event subject to said conditional biasing.

14. A game according to claim 11 wherein the board is divided into multi-region sectors and the game further comprises biasing integer recording and display means with which each player can record a biasing integer for each sector to determine the number of random number generating means used by a player in the course of playing-off for control of the playing piece when it is situated in a region of that sector, the rules providing that such playing-off is a specified event subject to said conditional biasing.

15. A game according to claim 14 wherein the biasing integer recording and display means for each player includes selectively displayable integer groups each group containing the same number of integers which number corresponds to the number of sectors on the board and the sum of the integers of each group being the same.

16. A game according to claim 14 wherein the rules provide that a player may at certain stages of the game change the biasing integers recorded for each sector.

17. A board game comprising:

(i) a board defining a playing area divided into two halves each of which is subdivided into regions each bearing an indicia;

(ii) a playing piece for movement between the regions;

(iii) means for randomly determining to which region the playing piece is moved;

(iv) means for randomly determining the outcome of an event associated with the region on which the playing piece is situated;

(v) rules determining how two opposing players may move the playing piece in an attempt to achieve a specified aim; and (vi) wherein at least one region of each half is marked to indicate that a player moving the playing piece to that region loses control of the playing piece.

18. A board game comprising:

(i) a board defining a playing area divided into two halves each of which is subdivided into regions each bearing an indicia;

(ii) a playing piece for movement between the regions;

(iii) means for randomly determining to which region the playing piece is moved;

(iv) means for randomly determining the outcome of an event associated with the region on which the playing piece is situated;

(v) rules determining how two opposing players may move the playing piece in an attempt to achieve a specified aim; and (vi) further comprising cards which provide, in a random manner, instructions concerning the playing of the game and at least one region of each half is marked to indicate that a player moving the playing piece to that region should draw one of the cards.

19. A game according to claim 18 wherein some cards include instructions to be followed immediately upon being drawn and others included strategic instructions and may be retained by a player for subsequent use.

20. A game according to claim 18 or including plural different sets of cards and each region marked to indicate that a card should be taken is also marked to indicate from which set a card should be drawn.

21. A game according to claim 18 wherein the rules determine that when the playing piece moves to a region marked to indicate that a card should be drawn, a play-off between the players occurs to determine what subsequent action should be taken.

22. A board game comprising:

(i) a board defining a playing area divided into two halves each of which is subdivided into regions each bearing an indicia;

(ii) a playing piece for movement between the regions;

(iii) means for randomly determining to which region the playing piece is moved;

(iv) means for randomly determining the outcome of an event associated with the region on which the playing piece is situated;

(v) rules determining how two opposing players may move the playing piece in an attempt to achieve a specified aim; and (vi) wherein the board represents an American football pitch divided into ten strips each further subdivided into ten parts each representing one yard of a real pitch and the game further includes:

(a) a ten yard chain marker for selectively marking one of the strips of the board representing a ten yard strip of a real pitch;

(b) a play position marker separate from the playing piece for temporarily marking a point of progress during a player's turn; and (c) a "downs" indicator for indicating how many "downs" or plays of a player's turn have been used.

23. A game according to claim 22 wherein the "downs" indicator is adapted to individually and sequentially display the numbers 1 to 4.

24. A game according to claim 23 further comprising random play type determining means for determining whether an offensive player is to use "passing play" or "running play" in a turn and for determining whether a defending player is preparing to stop "passing play" or "running play" in that turn.

25. A game according to claim 24 wherein the play type determining means comprises a set of cards.

26. A game according to claim 24 wherein the rules provided that a player must achieve, in four "downs", progress on the board representing ten yards of a real pitch to maintain control of the playing piece.

27. A game according to claim 26 wherein each random determining means comprises a plurality of like random number generating means, and wherein the rules specify:

(i) the number of random number generating means used by each player, which numbers depend on instructions determined by the play type determining means; and (ii) how the numbers generated by the random number generating means are used to compute the players' progress or result in loss of control of the playing piece to the other player.

28. A game according to claim 26 wherein each random determining means comprises a plurality of like random number generating means, and wherein the rules provide that in a player's fourth "down" the random number generating means may be used to determine to which region of the opponent's half of the board the playing piece will move and this results in the opponent gaining control of the playing piece.

* * * * *